United States Patent [19]

Miller

[11] Patent Number: 4,493,622

[45] Date of Patent: Jan. 15, 1985

[54] VARIABLE DISPLACEMENT MOTOR

[75] Inventor: Laurence L. Miller, West Lafayette, Ind.

[73] Assignee: TRW Inc., Cleveland, Ohio

[21] Appl. No.: 472,858

[22] Filed: Mar. 7, 1983

[51] Int. Cl.[3] ..... F03C 2/00

[52] U.S. Cl. ..... 418/57; 418/60; 418/61 B; 417/310; 464/82; 464/156

[58] Field of Search ..... 418/19, 27, 57, 60, 418/61 B; 417/310, 440; 91/59; 173/12; 464/74, 82, 156, 160

[56] References Cited

U.S. PATENT DOCUMENTS

| | | | |
|---|---|---|---|
| 3,200,756 | 8/1965 | Ratliff, Jr. et al. . | |
| 3,687,578 | 8/1972 | White, Jr. et al. | 418/61 B |
| 3,784,336 | 1/1974 | Schultz | 418/61 B |
| 3,871,798 | 3/1975 | Berlich | 418/61 B |
| 4,082,480 | 4/1978 | McDermott | 417/310 |

*Primary Examiner*—John J. Vrablik
*Attorney, Agent, or Firm*—Yount & Tarolli

[57] ABSTRACT

A hydraulic motor which varies its displacement in accordance with varying torque loads on its output shaft. The motor is biased to a low displacement, low torque, high speed mode, and changes to a high displacement, high torque, low speed mode when the torque load on its output shaft increases. The motor has eccentrically disposed gerotor gears that rotate and orbit relative to each other to expand and contract fluid chambers on opposite sides of a center line of eccentricity. The gerotor gears can change their orientation relative to each other in response to changes in the torque load on the output shaft, changed, in order to change the displacement of the motor.

13 Claims, 8 Drawing Figures

VARIABLE DISPLACEMENT MOTOR

BACKGROUND OF THE INVENTION

The present invention relates to a load sensing variable displacement hydraulic motor which adjusts displacement in response to the load on its output shaft. The invention relates particularly to a hydraulic motor which operates in a low displacement, high speed mode when the torque load on its output shaft is low. The motor's displacement increases when the torque load on the output shaft increases.

In the prior art, there are disclosures of hydraulic motors whose displacement can be changed by an operator to change the speed and the output torque of the motor. For example, in U.S. Pat. No. 3,687,578, a hydraulic motor has rotatable gears with intermeshing teeth defining fluid chambers that may be expanded and contracted in order to rotate the gears and thereby drive an output shaft coupled to one of the gears. In the patent, one gear is shifted relative to another gear (either axially or angularly) to change the volume of the chambers, and thereby change the hydraulic displacement of the motor. In U.S. Pat. No. 3,687,578, the displacement of the motor is changed by external means (e.g., an external source of fluid, a hand crank) which shifts the gears relative to each other in order to change the volume of fluid displaced by the motor.

Another example of a hydraulic motor with a variable volume displacement is shown in U.S. Pat. No. 3,200,756. That patent discloses a vane-type motor with a cam ring which is biased to a position in which its inlet opening has a maximum flow area to provide a maximum displacement. In response to an increasing speed on its output shaft, centrifugal force increases the frictional engagement between the vanes and the cam ring. The cam ring then rotates to decrease the size of the inlet opening, to reduce the displacement of the motor. Thus, the motor of the patent is biased to its high displacement, high torque, low speed mode, and responds to increasing shaft speed to decrease its displacement and its output torque.

SUMMARY OF THE INVENTION

The present invention relates to a load sensitive, variable displacement hydraulic motor in which the displacement responds to varying torque load on an output shaft. The motor operates in a low displacement, low torque mode when the torque load on its output shaft is low, and changes to a high displacement, high torque mode when the torque load on its output shaft increases. Unlike U.S. Pat. No. 3,687,578, the motor of the invention has the capacity to adjust displacement in accordance with changing load conditions, and unlike U.S. Pat. No. 3,200,756, the motor of the invention is biased to a low displacement, low torque mode, and changes to a high displacement, high torque mode when the torque load on its output shaft increases.

The motor of the invention includes a gerotor gear set with eccentric gears that rotate and orbit relative to each other to expand and contract fluid chambers formed between the gears, and a commutation valve that communicates an inlet port with some of the fluid chambers and communicates an exhaust port with the remaining fluid chambers as the gears rotate and orbit relative to each other. A center line of commutation separates the fluid chambers that are communicated with one port from the fluid chambers that are communicated with the other port. Also, a center line of eccentricity separates the expanding and contracting fluid chambers from each other. The center line of commutation is coincident with the center line of eccentricity when the motor has its maximum displacement. When the center line of commutation forms an angle relative to the center line of eccentricity, the displacement of the motor decreases as the angle increases. Displacement of the motor varies as the center line of commutation and the center line of eccentricity move relative to each other.

The motor of the invention is specifically designed so that the relative position of the commutator's center line of commutation and the center line of eccentricity of at least one gear set in the motor changes when the torque load on the output shaft changes. The displacement of the motor changes as a function of the change in the relative position of the center line of commutation of the commutator and the center line of eccentricity of the gear set. Thus, the displacement of the motor changes when the torque load on the output shaft changes.

In the preferred embodiment, the gear set comprises an outer gerotor gear (stator) which has limited rotation, and an inner movable gerotor gear which can rotate and orbit relative to the outer gerotor gear. Springs act between the outer gerotor gear and the motor's housing. The springs bias the outer gerotor gear toward a predetermined orientation in the housing. When the outer gerotor gear is in the predetermined orientation, the motor has minimum displacement and operates in a low displacement, low torque mode.

During operation of the motor, if the torque load on the output shaft increases, the pressure in the fluid chambers on the inlet side of the motor increases. The increased pressure in the fluid chambers on the inlet side of the motor leads to an increased moment acting on both outer and inner gerotor gears of the motor. When this moment exceeds the biasing force of the springs acting between the housing and the outer gear, the outer gear will rotate a limited amount. When the outer gerotor gear pivots against the bias of the springs, the center line of eccentricity of the gearset shifts angularly relative to the center line of commutation of the commutator in order to increase the motor's displacement and output torque.

BRIEF DESCRIPTION OF THE DRAWINGS

Further objects and advantages of the present invention will become further apparent from the following detailed description taken with reference to the accompanying drawings wherein.

DETAILED DESCRIPTION OF THE PREFERRED EMBODIMENTS

The principles of the present invention can be embodied in a unidirectional motor having an output shaft which rotates in one direction only. Such a motor is illustrated in FIGS. 1–4. Further, the principles of the invention can be embodied in a bi-directional motor, having an output shaft which can turn in either direction. Such a motor is illustrated in FIGS. 5–8.

Figure 1:
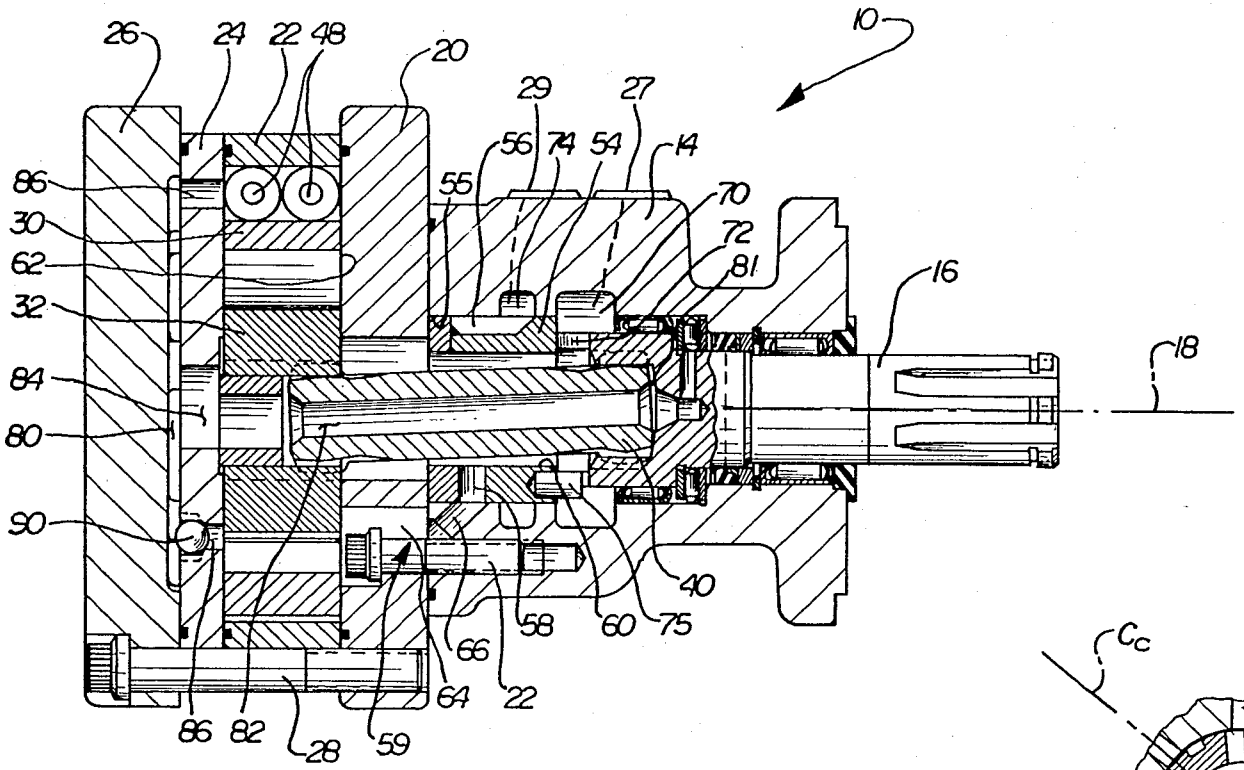
FIG. 1 is a longitudinal sectional view of a hydraulic motor constructed according to the principles of the present invention.
Figure 4:
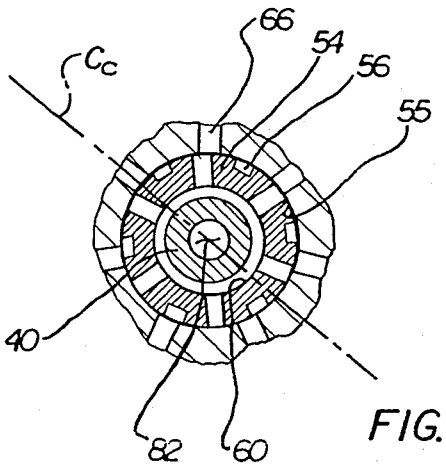
FIG. 4 is a fragmentary, radial sectional view of the commutator valve in the motor of FIG. 1.

Referring to FIG. 1, a uni-directional motor constructed according to the invention is shown at 10. It includes a housing formed by (i) a cast member 14 which supports an output shaft 16 for rotation about a central axis 18, and (ii) a series of plates 20, 22, 24, 26 which are fixedly connected to each other (by bolts 28). The housing includes an inlet port 27 for receiving high pressure fluid from a source and an exhaust port 29 for directing low pressure fluid to a reservoir.

A pair of gerotor gears 30, 32 are located in the portion of the housing comprised of the fixed plates 20, 22 and 24. The outer gerotor gear 30 (stator) is supported by the housing plate 22 for partial rotation, i.e., pivoting, about a central axis which coincides with the central axis 18 of the output shaft 16. The outer gerotor gear 30 includes a series of internal teeth which may be formed by cylindrical roller vanes 34 (FIGS. 2, 3) supported in respective arcuate slots, in accordance with the principles disclosed in U.S. Pat. No. 3,289,602. The inner gerotor gear 32 includes a series of external teeth 38, numbering one less than the number of internal teeth on the outer gerotor gear 30. The central axis of the inner gerotor gear 32 is eccentrically located relative to the central axis of the outer gerotor gear 30. The inner gerotor gear 32 can rotate and orbit relative to the outer gerotor gear 30.

Figure 3:
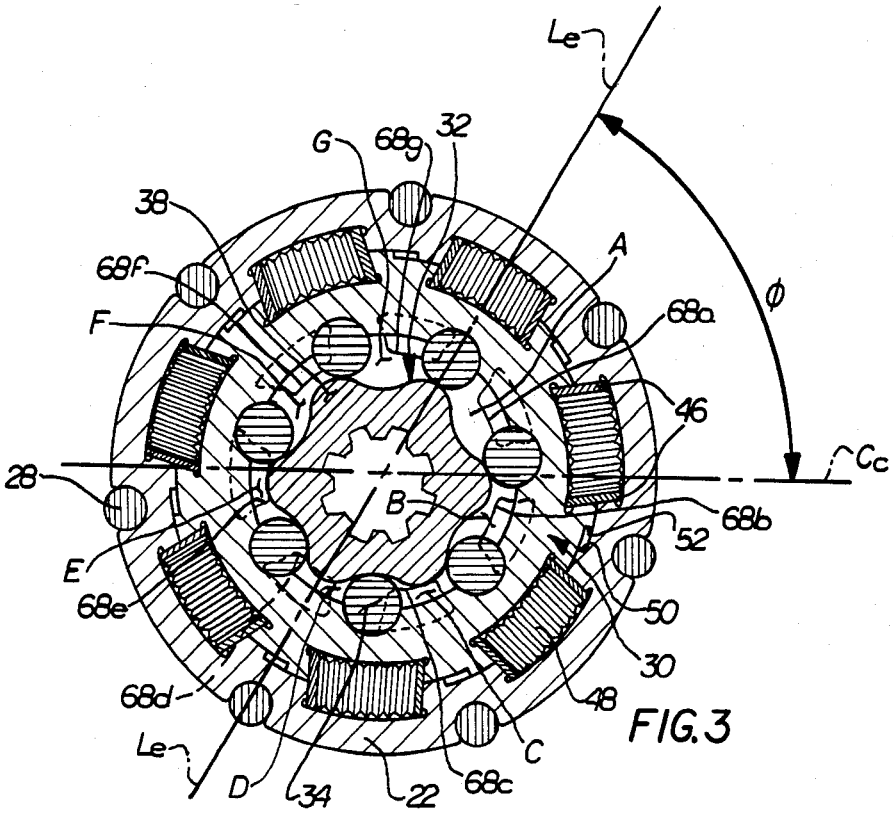
FIGS. 2 and 3 are radial sectional views of the gearset in the motor of FIG. 1, showing the elements of the gearset in a maximum displacement condition (FIG. 2) and a minimum displacement condition (FIG. 3)
Figure 2:
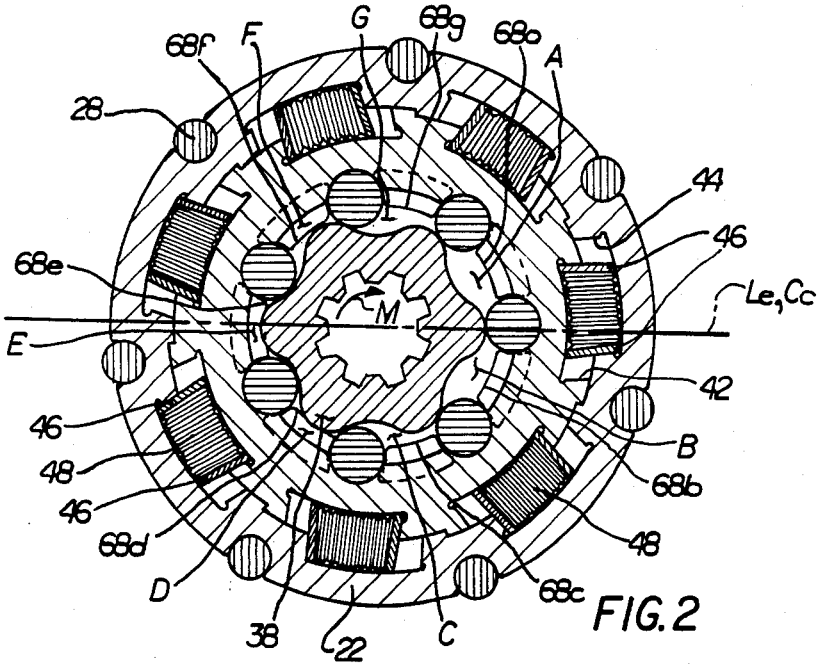

The intermeshing teeth of the inner and outer gerotor gears 30, 32 define fluid chambers which expand and contract as the gerotor gears rotate and orbit relative to each other. Referring to FIGS. 2, 3, the gears define seven fluid pockets, labelled A–G. When properly controlled, fluid pressure can cause the inner gerotor gear 32 to rotate about the central axis 18 and orbit relative to the outer gerotor gear 30. The motion of the inner gear 32 expands and contracts fluid chambers on opposite sides of a center line of eccentricity $L_e$ which runs through the central axes of the inner and outer gerotor gears 30, 32. For example, when the gerotor gears are in the orientation shown in FIG. 2, the center line of eccentricity $L_e$ passes through the one tooth on the inner gerotor gear 32 which has a maximum insertion in the fluid chamber E, and the diametrically opposite tooth which is in tangential sealing engagement with a roller vane on the outer gerotor gear 30. The fluid chambers A, F, G on one side of the center line of eccentricity $L_e$ are expanding, and the fluid chambers B, C, D on the other side of the center line of eccentricity $L_e$ are contracting. The one chamber which has a tooth at maximum insertion (i.e., pocket E) is switching from one condition (i.e., expanding or contracting) to the other condition. It is often referred to as a "null" chamber.

When the gears are in the orientation of FIG. 2 high pressure fluid is being communicated from the inlet port 27 to all of the expanding chambers A, F, G on one side of the center line of eccentricity $L_e$ and low pressure fluid from all the contracting chambers B, C, D on the other side of the center line of eccentricity $L_e$ is being communicated with the exhaust port 29. The null fluid chamber E is blocked from the inlet port 27 and the exhaust port 29. Consequently, the high pressure fluid would cause a moment M on the inner gerotor gear 32. As viewed in FIG. 2, the moment M causes the inner gerotor gear 32 to rotate clockwise about its own axis and to orbit counterclockwise about the axis of the outer gerotor gear 30. The rotation of the inner gerotor gear 32 about its own axis is transmitted, via an angular drive link 40 (wobble shaft), to the output shaft 16 and drives the output shaft 16 at the speed at which the inner gerotor gear 32 rotates about its own axis.

According to the invention, there is a specially constructed coupling between the outer gerotor gear 30 and the housing member 22. That coupling enables the outer gerotor gear 30 to partially pivot about the central axis 18 in order to change angular position or orientation relative to the inner gerotor gear 32. Referring to FIGS. 2 and 3, the outer periphery of the outer gerotor gear 30 has a series of recesses 42, and the housing member 22 has a corresponding number of opposite recesses 44. A pair of plates 46 extend between corresponding recesses in the outer gerotor gear 30 and the housing member 22, and a series of Belleville springs 48 are disposed between each pair of plates 46. The Belleville springs 48 act on the plates 46 and normally bias the outer gerotor gear 30 toward the position shown in FIG. 3 in which the recesses 42 in the outer gerotor gear 30 and the recesses 44 in the housing member 22 are aligned. The outer gerotor gear 30 can pivot clockwise about its axis, toward the position of FIG. 2, to increase the displacement of the motor. The Belleville springs 48 may be compressed to allow the outer gerotor gear 30 to pivot clockwise about its axis toward the position shown in FIG. 2. A series of engageable stops 50, 52 on the housing member 22 and the outer gerotor gear 30, respectively, cooperate to limit the pivoting of the outer gerotor gear 30.

A commutation valve means is provided for directing fluid to and from the fluid chambers defined by the gerotor gears 30, 32. The commutation valve means is constructed according to the principles of U.S. Pat. No. 3,087,436. It includes a sleeve-type commutator valve element 54 (FIGS. 1, 4) which is coupled to the output shaft 16 for joint rotation therewith. The sleeve-type commutator valve element 54 is disposed in a central bore 55 formed in the housing member 14. The valve element 54 includes alternating (i) axially extending slots 56 which extend to its outer periphery and (ii) radial extending passages 58 which extend from a central passage 60 in the valve element 54 to the outer periphery of the valve element 54. The number of axially extending slots 56 and radially extending passages 58 is equal to twice the number of teeth 38 on the inner gerotor gear 32.

The housing members 14, 20 include manifold passages 59 which extend from the end face 62 of the housing member 20 which is adjacent the gerotor gears 30, 32 to the bore 55 in the housing member 14. The manifold passages 59 include axial passages 64 in the housing member 20 and angular passages 66 in the housing member 14. The number of manifold passages 59 is equal to the number of fluid chambers defined by the gerotor gears 30, 32, with each manifold passage communicating with a respective fluid pocket. Referring to FIG. 2, the passages 64 in the housing member 20 define seven oblique, arcuate manifold openings 68*a*–68*g* in the end face 62 of housing member 20, which openings 68*a*–68*g* communicate with the fluid chambers defined by the gerotor gears 30, 32.

In the motor of FIGS. 1–4, high pressure fluid from the inlet port 27 is directed to an annular cavity 70 formed in the housing member 14. That high pressure fluid is directed through radial passages 72 in the output shaft 16 to the central passage 60 inside the commutator valve element 54 and to the radial passages 58 in the commutator valve element 54. Thus, the radial passages 58 in the valve element 54 are in continuous communication with the pressurized fluid supplied to inlet port 27. The longitudinal grooves 56 in the outer periphery of the valve element 54 are in continuous communication with an annular outlet cavity 74 formed in the housing member 14. The annular outlet cavity 74 is in communication with the exhaust port 29. Thus, the longitudinal grooves 56 in the valve element 54 are in continuous communication with the exhaust port 29.

The commutator valve element 54 is connected for joint rotation with the output shaft 16 by means of pins 75. Also, as set forth above, the angular drive link 40 couples the inner gerotor gear 32 and the output shaft 16 for joint rotation. Thus, as the inner gerotor gear 32 rotates and orbits relative to the outer gerotor gear 30, the commutator valve element 54 rotates jointly with the output shaft 16 and inner gerotor gear 32. Commutation valving occurs at the interface of the valve element 54 and the bore 55 in the housing member 14, as the alternate array of radial passages 58 and axial grooves 56 in the valve element 54 rotate relative to the manifold passages 59 in the housing member 14. As the valve element 54 rotates, the manifold passages 59 (i) direct high pressure inlet fluid from the inlet port 27 to some of the fluid chambers, and (ii) exhaust low pressure fluid from other fluid chambers to the exhaust port 29. A null pocket, i.e., the pocket E when the gears 30, 32 are in the orientation of FIG. 2, is blocked from communication with the inlet or exhaust ports.

In the illustrated example, if the motor parts are in the position shown in either of FIGS. 2 or 3, the manifold openings 68*a*, 68*f*, 68*g* would be communicated with high pressure fluid from the inlet port 27. The manifold openings 68*b*, 68*c*, 8*d* would be communicated with the low pressure exhaust port 29. The manifold opening 68*e* would be blocked from communication with the inlet or exhaust ports.

In hydraulic motors, the displacement of the motor is measured in terms of the number of cubic inches of fluid that are displaced during each revolution of the output shaft. As displacement increases a motor is capable of producing a higher torque. However, motors which have a high net displacement and a high output torque generally operate at a relatively low speed. On the other hand, if the displacement of the motor is relatively low, the motor will require less fluid during each revolution and will produce a lower torque, but will operate at a higher speed.

In the motor of FIGS. 1–4, the commutator valve element 54 has a center line of commutation $C_c$ that passes through the center of the commutator valve element 54 and separates the fluid chambers that are communicated with one port from the fluid chambers that are communicated with the other port. When the gerotor gears 30, 32 are in the high displacement orientation of FIG. 2, the center line of commutation $C_c$ is coincident with the line of eccentricity $L_e$ of the gear set, and extends through the null fluid chamber E. The expanding fluid chambers A, F, G on one side of the center line of eccentricity $L_e$ and the center line of commutation $C_c$ are all receiving high pressure fluid from the inlet port 27 through the manifold openings 68*a*, 68*f*, 68*g*. The contracting fluid chambers B, C, D on the other side of the center line of eccentricity $L_e$ and the center line of commutation $C_c$ are all exhausting fluid to the exhaust port 29 through the manifold openings 68*b*, 68*c*, 68*d*. In this orientation, the gerotor gears 30, 32 can displace a maximum amount of fluid during each revolution of the inner gerotor gear 32 about its central axis. Thus, when the center line of commutation $C_c$ 30, 32 coincides with the line of eccentricity $L_e$ of the gerotor gears, the motor has its maximum displacement.

In FIG. 3 the orientation of the gerotor gears 30, 32 has been changed by pivoting the outer gerotor gear counterclockwise about 7.5°. The three manifold openings 68*a*, 68*f*, 68*g* which receive high pressure fluid from the inlet port 27 when the gerotor gears 30, 32 are in the position of FIG. 2, also receive high pressure fluid when the gerotor gears are in the position of FIG. 3. Similarly, the three manifold openings 68*b*, 68*c*, 68*d* which are exhausting fluid to the exhaust port 29 when the gerotor gears are in the position of FIG. 2 are also exhausting low pressure fluid to the exhaust port 29 when the gerotor gears are in the position of FIG. 3. Thus, the center line of commutation $C_c$ is unchanged. However, the orientation of the center line of eccentricity $L_e$ has changed. In FIG. 3, the center line of eccentricity $L_e$ has pivoted, relative to the center line of commutation $C_c$, through an angle $\phi$ of approximately 45°. As can be seen in that drawing there are two expanding fluid chambers F, G on one side of the center line of eccentricity $L_e$ receiving high pressure fluid from the inlet, but the third fluid chamber which is communicated with the high pressure inlet is the fluid chamber A which is on the other side of the center line of eccentricity $L_e$ and which is now contracting. Low pressure fluid is being exhausted to the low pressure return port from two of the contracting chambers B, C on one side of the center line of eccentricity $L_e$, but the other chamber D which is communicated with the low pressure return port is on the other side of the center line of eccentricity $L_e$ and is now expanding. When the gerotor gears are operating in the orientation of FIG. 3, the volume of the fluid chambers communicated with the inlet has been reduced, and the volume of the fluid chambers communicated with the outlet has been reduced by a corresponding amount, so that the motor's displacement has been reduced. The motor cannot displace as much fluid per revolution of the output shaft 16, and thus cannot produce as high an output torque, as when the gerotor gears 30, 32 are operating in the orientation of FIG. 2. In the motor of FIGS. 1–4, when the gerotor gears are in the orientation shown in FIG. 3 the angle $\phi$ between the center line of eccentricity $L_e$ and the center line of commutation $C_c$ has its largest value, and the motor has its minimum displacement.

As the angle $\phi$ betwen the center line of commutation $C_c$ and the center line of eccentricity $L_e$ of the gear set increases, the amount of fluid that flows into the fluid chambers that are communicated with the inlet port decreases, and the displacement of the motor decreases. Conversely, as the angle $\phi$ decreases, the amount of fluid that flows into the fluid chambers that are communicated with the inlet port increases, and the displacement of the motor increases. Thus, as the gerotor gears 30, 32 shift between the orientation of FIG. 2 and the orientation of FIG. 3, the displacement of the motor varies as the angle $\phi$ between the center line of commutation $C_c$ and the center line of eccentricity $L_e$ changes.

The Belleville springs 48 bias the gerotor gears 30, 32 toward the minimum displacement orientation shown in FIG. 3. Unless the torque load on the output shaft causes the outer gerotor gear 30 to pivot against the bias of the Belleville springs 48, the motor will operate in a low displacement, high speed mode.

In response to an increasing torque load on its output shaft 16 and consequent increase in working pressure in the chambers A, F, and G, the outer gerotor gear 30 is caused to pivot against the bias of the Belleville springs 48, to shift the gerotor gears toward the orientation of FIG. 2. More specifically, when the load on the output shaft 16 increases, the mechanical and hydraulic forces acting between the gerotor gears 30, 32 will act on the outer gerotor gear 30 and cause the outer gerotor gear 30 to pivot against the bias of the Belleville springs 48 toward the orientation of FIG. 2. The center line of eccentricity $L_e$ will pivot angularly relative to the center line of commutation $C_c$ by an amount which depends upon the magnitude of the torque load increase. The motor's displacement, and consequently the torque produced by the motor, will increase. Thus, the motor will be sensitive to and adjust to an increasing torque load on the output shaft to increase the output torque. When the torque load on the motor's output shaft reduces, the pressures in the working chambers A, F and G reduce and the Belleville springs 48 can shift the outer gerotor gear 30 toward the postion of FIG. 3, to reduce the displacement of the motor.

Of course, it should be remembered that the positions of the gerotor gears 30, 32 shown in FIGS. 2 and 3 are instantaneous positions. In practice, the gerotor gears 30, 32 may be constantly changing their positions, as the inner gerotor gear 32 rotates and orbits, and the outer gerotor gear 30 shifts between the orientations of FIGS. 2 and 3 as the torque load on the output shaft 16 changes. As the outer gerotor gear 30 changes its orientation, i.e., between the maximum displacement orientation of FIG. 2 and the minimum displacement orientation of FIG. 3, the displacement of the motor will vary between the maximum and minimum values. Specifically, it will vary in accordance with varying torque loads on the output shaft.

As the motor adjusts its displacement, high pressure inlet fluid will be trapped in a chamber which is not connected to the inlet or exhaust ports. If fluid trapped in such a chamber is further pressurized, by contraction of the pocket, the efficiency of the motor will be adversely affected. The motor of the invention provides structure for relieving the effect of any such trapping. Specifically, the housing plate 26 at one end of the motor includes a pressure cavity 80, and fluid from the inlet cavity 70 is directed to the pressure cavity 80 through (i) a central passage 82 in the wobble shaft, (ii) the center of the inner gerotor gear 32, and (iii) a central passage 84 in the housing plate 24. Fluid from the cavity 70 flows into passage 82 through the splines that connect of the drive link 40 with the shaft 16, and a radial passage 81. The housing plate 24 has a series of axial passages 86 corresponding to the number of fluid chambers, with each axial passage 86 being aligned with a respective fluid chamber. A one-way ball check valve 90 is provided in each axial passage 86. A ball check valve 90 is biased by the high pressure fluid in pressure cavity 80 into the position shown in FIG. 1 if the fluid pressure in the cavity 80 exceeds the pressure in the chamber associated with the ball check valve. In that position, there is no communication between the pressure cavity 80 and the chamber. A ball check valve 90 can be unseated, to relieve fluid pressure in a chamber, if fluid pressure in the chamber exceeds the inlet pressure in pressure cavity 80. Thus, when fluid is trapped in a chamber, and pressure in that chamber builds to a level above inlet pressure, the ball check valve 90 associated with that chamber will unseat, in order to relieve that pressure to the cavity 80.

Referring now to FIGS. 5–8, there is shown another motor embodying the principles of the invention The motor of FIGS. 1–4 is a unidirectional motor, and the motor of FIGS. 5–8 is bi-directional. The motor of FIGS. 5–8 has an output shaft 100 which can rotate in either direction, depending upon which of its two ports 101, 103 is used as an inlet port to receive fluid from a source and which of its ports is used as an outlet port to exhaust fluid to a reservoir.

Figure 5:
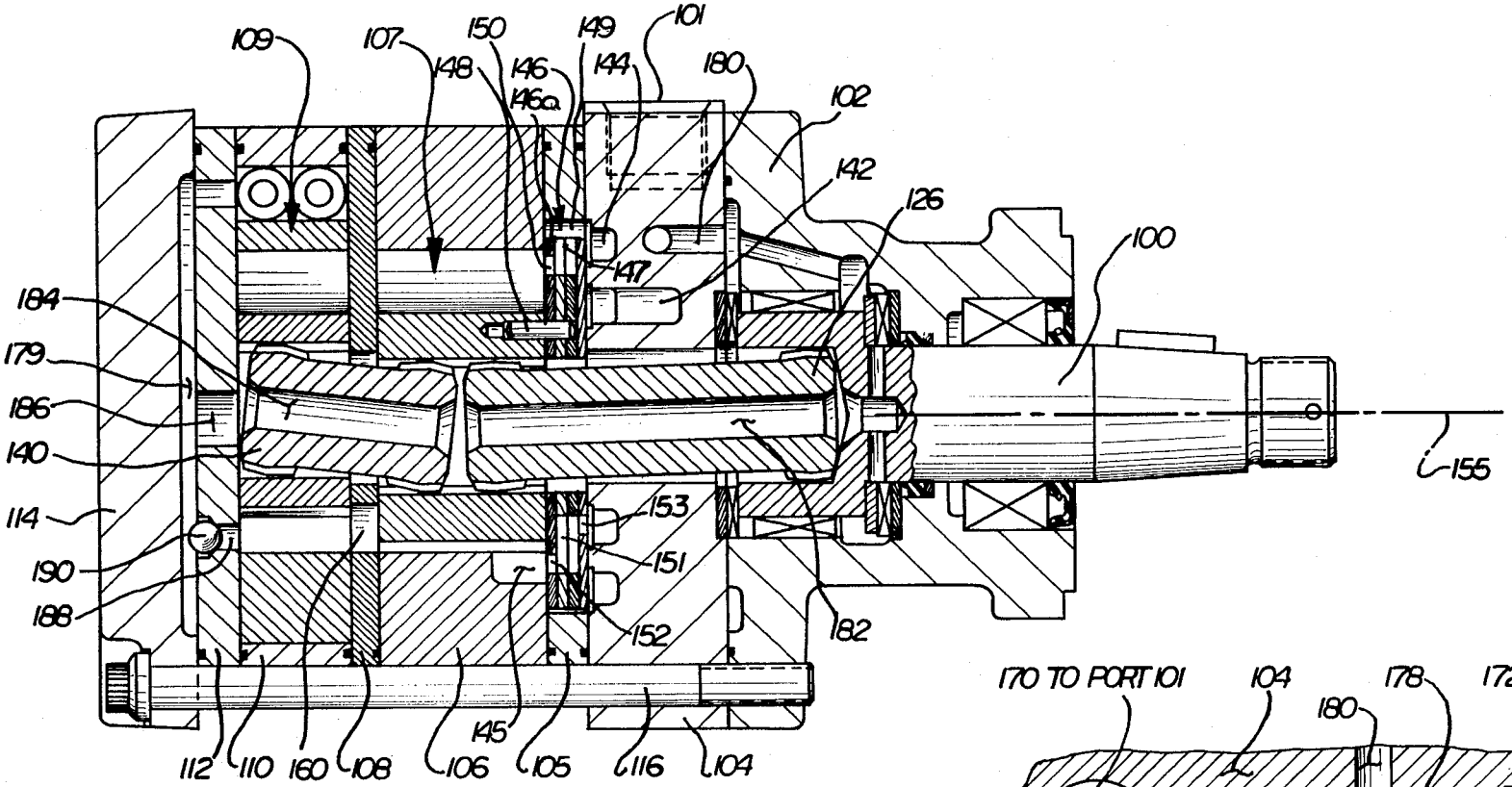
FIG. 5 is a longitudinal sectional view of another motor constructed according to the principles of the present invention.

As seen in FIG. 5, the motor has a housing comprising (i) a cast member 102 which rotatably supports the output shaft 100 for rotation about a central axis 155, and (ii) a series of plates 104, 105, 106, 108, 110, 112, 114 fixedly connected to the cast member 120 by means of bolts 116.

The motor of FIGS. 5–8 includes a primary gerotor gear set 107 disposed between the housing plates 105 and 108, and a secondary gerotor gear 109 set disposed between the housing plates 108 and 112. Each of the gerotor gear sets 107, 109 has a respective center line of eccentricity $L_e$, and a commutation valve has a common center line of commutation $C_c$ for both gear sets 107, 109. When the motor has its minimum displacement, the center lines of eccentricity of the gear sets are in line (i.e., lie in the same plane), but the eccentricity $e_2$ of the secondary gear set is 180° out of phase with the eccentricity $e_1$ of the primary gear set. When the torque load on the motor's output shaft increases, the outer gear of the secondary gear set can rotate to a limited extent in the housing. When the outer gear of the secondary gear set rotates, the center line of eccentricity of the secondary gear set becomes angularly offset from the center line of eccentrity of the primary gear set. The displacement of the motor increases as the amount by which the center line of eccentricity of the secondary gear set is angularly offset from the center line of eccentricity of the primary geart set increases. When the center line of eccentricity of the secondary gear set is angularly offset by 90° from the center line of eccentricity of the primary gear set, the motor has its maximum displacement.

The primary gerotor gear set 107 includes an internally toothed outer gerotor gear 120 formed by a series of roller vane teeth 123 carried on the fixed housing plate 110. An inner gerotor gear 124 includes a series of external teeth 126, numbering one less than the number of teeth on the outer gerotor gear 120. The outer gerotor gear 120 is fixed, relative to the housing, by means of the bolts 116 so that its position in the housing does not change. The inner gerotor gear 124 can rotate and orbit relative to the outer gerotor gear 120. The inner gerotor gear 124 is connected to the output shaft 100 by means of an angular drive link 126, so that the output shaft 190 rotates jointly with the inner gerotor gear 124.

Figure 6:
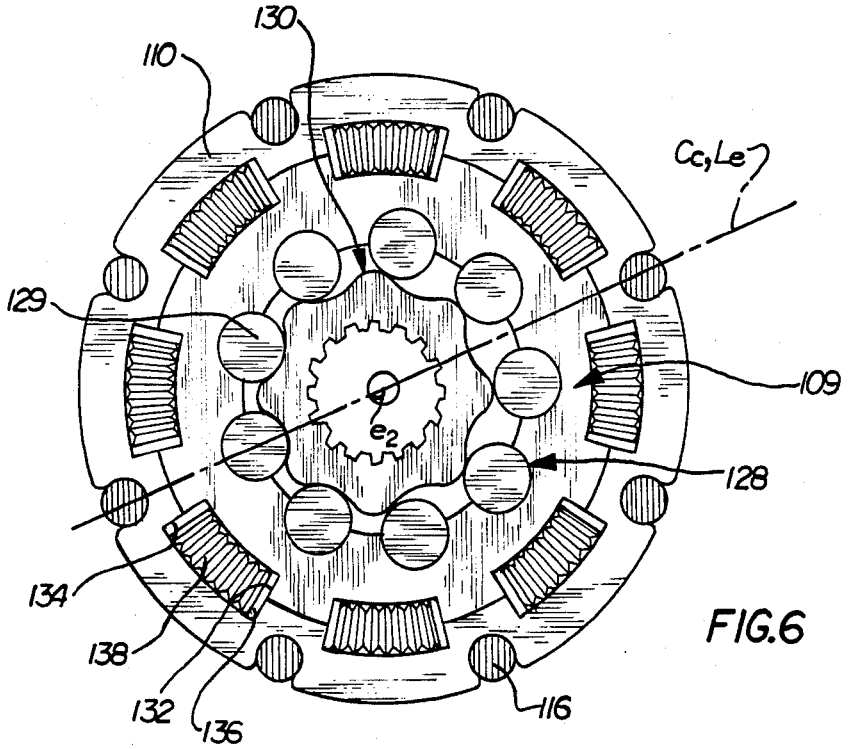
FIG. 6 is a radial view of the right side of the primary gear set in the motor of FIG. 5, in one of its operative positions.

The secondary gerotor gear set 109 is shown in FIGS. 5 and 6. It includes an internally toothed outer gerotor gear 128 with roller vane teeth 129, and an externally toothed inner gerotor gear 130, having one less tooth than the outer gerotor gear 128, and which can rotate and orbit relative to the outer gerotor gear 128.

In the secondary gear set, the outer gerotor gear 128 is supported for limited rotation by the housing plate 110. The outer gerotor gear 128 has a series of external recesses 132 and the housing plate 110 has a corresponding number of internal recesses 134. A pair of plates 136 and 137 and a series of Belleville springs 138 are located between each of the recesses 132, 134 and act to bias the outer gerotor gear toward the position of FIG. 6, in a manner similar to that of the previous embodiment. Thus, the outer gerotor gear 128 can partially rotate (pivot) against the bias of the Belleville springs 138 to change its orientation relative to the housing and to the inner gerotor gear 130. The inner gerotor gear 130, which can rotate and orbit relative to the outer gerotor gear, is coupled to the inner gerotor gear 124 of the primary gerotor gear set by means of an angular drive link 140 (FIG. 5). Thus, the inner gerotor gears 124, 130 of the primary and secondary gear sets are coupled together in such a way that they must rotate jointly but they can orbit relative to each other.

The housing plate 104 includes a pair of concentric annular grooves 142, 144. The annular groove 142 is connected to one port and the other annular groove 144 is connected to the other port.

A commutator valve plate 146 is connected to the inner gerotor gear 124 by means of pins 148 so that it rotates and orbits with the inner gerotor gear 124. The commutator plate valve 146 is preferably constructed of four plate members in accordance with the principles of U.S. Pat. No. 4,219,313. The end plate 146*a*, which is adjacent to the primary gerotor gears 120, 124 includes pairs of openings 150, 152. The openings 150, 152 face the primary gerotor gears 120, 124 and are shown in phantom in FIG. 7. Also, as seen from FIG. 7, the pairs of openings 150, 152 are arranged in a circular pattern. The commutator plate 146 includes passages 147 which continuously connect the openings 150 with a fluid cavity 49 that surrounds the commutator plate 146, and which is in communication with the annular groove 144 in the housing (see FIG. 5). The commutator plate 146 also includes passages 151, 153 which continuously connect the other openings 152 with the other annular grooves 142 in the housing (also, FIG. 5). Thus, each of the openings 150 is continuously connected with one port and each of the openings 152 is continuously connected with the other port.

The side of the outer gerotor gear 128 which is adjacent to the commutator plate 146 has a series of V-shaped recesses 145 disposed between the roller vane teeth of the outer gerotor gear 128. The pairs of openings 150, 152 commutate against the V-shaped recesses 145 in the outer gear 120 in order to direct fluid to and from the fluid chambers as the inner gerotor gear 124 rotates and orbits.

Assume, for example, that the openings 150 were all communicated with the high pressure port and the openings 152 communicated with the low pressure exhaust port. In the primary gerotor gear set 107, the openings 150 at high pressure would be communicated with the expanding pockets on one side of the center line of eccentricity $L_e$ and the openings 152 at low pressure would be communicated with the contracting pockets on the other side of the center line of eccentricity $L_e$, as can be seen from FIG. 7. A center line of commutation $C_c$, which is common for both the primary and secondary gear sets, extends through the center of the commutator plate 146 and is coincident with the center line of eccentricity $L_e$ of the primary gear set 107.

Each of the spaces between the teeth of the outer gerotor gear 120 of the primary gear set 107 is continuously communicated to a respective space between the teeth of the outer gerotor gear 128 of the secondary gear set 109, via axial passages 160 which are formed in the fixed plate 108 (FIG. 5) and extend between the primary and secondary gerotor gear sets. Fluid communicated from the commutator plate 146 to a space between the teeth of the outer gerotor gear 120 of the primary gear set is also communicated to a corresponding space between the teeth of the outer gear 128 of the secondary gear set via an axial passage 160. Thus, fluid is communicated between the fluid chambers of the secondary gear set and the inlet and outlet ports through the commutator valve, the primary gear set and the axial passages 160.

The primary and secondary gear sets are assembled in the motor so that they are out of phase with each other, i.e., their lines of eccentricity are in line but the eccentricities of the gear sets are 180° out of phase. The amount by which the eccentricities of the gear sets are out of phase with each other can change, as the torque load on the motor's output shaft changes. The displacement of the motor changes when the phase relationship of the primary and secondary gear sets changes.

The chambers formed by the primary gear set 107 are longer axially, than the chambers formed by the secondary gear set 109. When the eccentricities of the gear sets are 180° out of phase with each other, their center lines of eccentricity $L_e$ coincide with the common line of commutation $C_c$. As the center line of eccentricity of the secondary gear set 109 shifts toward a condition where it is 90° out of phase with the center line of eccentricity of the primary gear set 107, the center line of eccentricity of the secondary gear set also shifts angularly relative to the common center line of commutation $C_c$. The amount by which the eccentricity $e_2$ of the secondary gear set 109 is out of phase with the eccentricity $e_1$ of the primary gear set 107 decreases, and the displacement of the motor increases. When the center line of eccentricity of the secondary gear set is angularly offset by 90° from the common center line of commutation $C_c$, the displacement of the motor is a maximum value.

Figure 7:
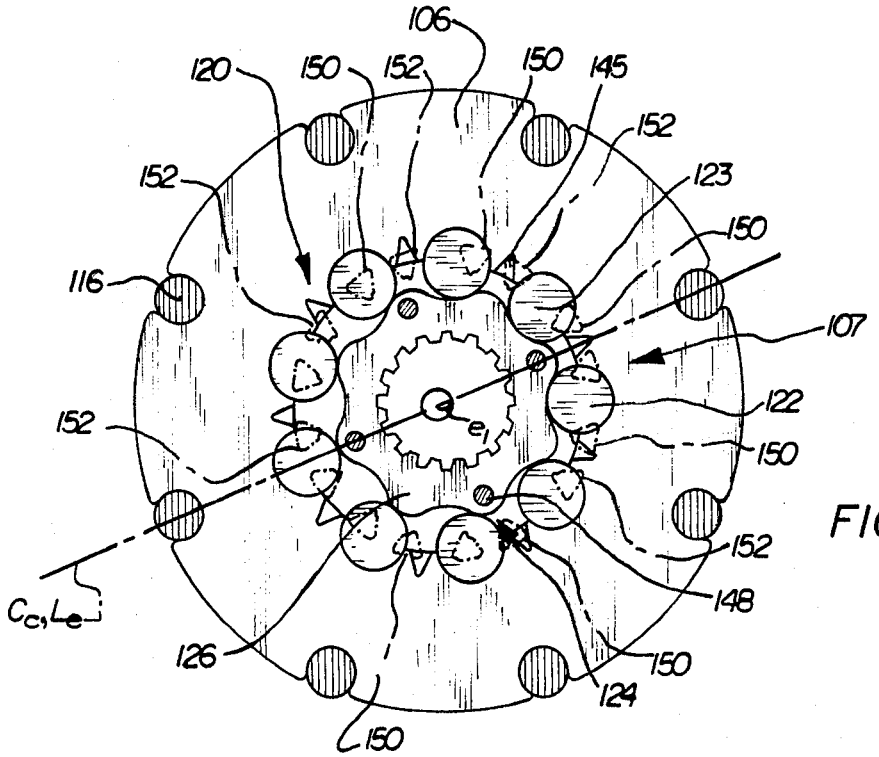
FIG. 7 is a radial view of the right side of the secondary gear set in the motor of FIG. 5, when the primary gear set is in the position of FIG. 6, and the motor is in its minimum displacement position.

The secondary gear set 109 is designed so that the Belleville springs 138 bias the secondary gerotor gear set to an orientation where its center line of eccentricity is in line with the center line of eccentricity of the primary gear set 107 but its eccentricity $e_2$ is 180° out of phase with the eccentricity $e_1$ of the gear set, i.e., an orientation in which the motor has a minimum displacement. FIGS. 6 and 7 show the primary and secondary gear sets in that condition.

In response to an increasing torque load on the output shaft, the combination of fluid pressures in the secondary gear set 109 cause the outer gerotor gear 128 of the secondary gear set to rotate against the bias of the Belleville springs 138. As the outer gerotor gear 128 rotates, its center line of eccentricity $L_e$ shifts angularly relative to the common line of commutation $C_c$. The amount by which the eccentricity of the secondary gear set 109 is out of phase with eccentricity of the primary gear set 107 is reduced, and the displacement of the motor increases. Thus, with increasing torque load on its output shaft, the displacement of the motor will increase.

Figure 8:
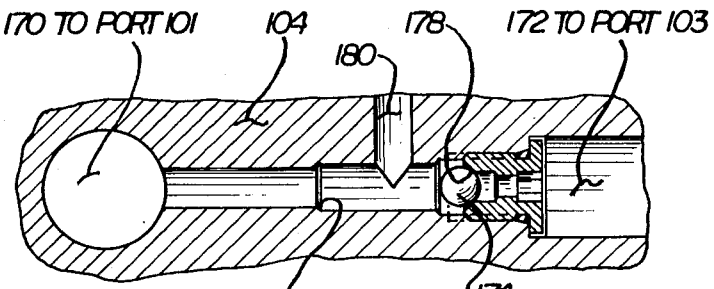
FIG. 8 is a fragmentary sectional view of a part of the motor of FIG. 5, showing the valve structure which directs high pressure fluid from the motor's inlet port to the center of the motor.

The motor of FIGS. 5–8 is also designed to prevent trapped fluid from exceeding the pressure of inlet fluid, regardless of which one of its ports is connected to the high pressure source. The housing members 102 and 104 include a valve and fluid passage arrangement for feeding high pressure fluid from the inlet port to the center of the device regardless of which port is the inlet port. Referring to FIG. 8, the housing member 104 has passages 170, 172 connected to the respective ports. A ball valve 174 is urged against one of a pair of seats 176, 178, depending on which port receives the higher pressure inlet fluid. That port is communicated with a passage 180 in the housing member 104. As seen from FIG. 5, the fluid in passage 180 is communicated through passages in the housing member 102 and to the center of the motor. The fluid is communicated to a pressure chamber 179 through passages 182, 184 in the drive links 126, 140, and a passage 186 in the housing plate 112. Thus, the pressure chamber 179 is communicated to the high pressure source, regardless of which port receives the high pressure. The housing plate 112 has a series of passages 188 communicating the pressure chamber 179 with the chambers of the secondary gerotor gear set, and a one-way ball check valve 190 in each of those passages. Thus, the device prevents trapping in the same way as the previous embodiment.

What is claimed is:

1. A hydraulic motor comprising:

an inlet port for receiving high pressure fluid and an exhaust port for exhausting low pressure fluid, fluid displacement means comprising relatively rotatable and orbital gerotor gears, said gerotor gears having intermeshing teeth which define fluid chambers that expand and contract as the gerotor gears rotate and orbit relative to each other, an output shaft, means coupling one of said gerotor gears with said output shaft for applying a torque to said output shaft as said gerotor gears rotate and orbit relative to each other, and commutation valve means for directing fluid from said inlet port to some of the fluid chambers defined by said gerotor gears and for directing fluid from other fluid chambers to said exhaust port according to the torque load imposed upon the output shaft, said gerotor gears defining a center line of eccentricity which separates expanding chambers from the contracting chambers as the gears rotate and orbit, said commutation valve means having a center line of commutation that separates the fluid chambers that are being communicated with said inlet port from the fluid chambers that are being communicated with said exhaust port as the gears rotate and orbit, and means associated with said other of said gerotor gears for effecting a change in angular position of said other of gerotor gears with respect to said one of said gerotor gears in response to a change in a torque load on said output shaft for enabling a change in the orientation of the center line of eccentricity of the gear set relative to the center line of commutation of the commutation valve means to thereby change the displacement of said hydraulic motor.

2. A hydraulic motor comprising fluid displacement means comprising relatively rotatable and orbital gerotor gears, and gerotor gears having intermeshing teeth which define fluid chambers that expand and contract as the gerotor gears rotate and orbit relative to each other, an output shaft, means coupling one of said gerotor gears with said output shaft for applying a torque to said output shaft as said gerotor gears rotate and orbit relative to each other, commutation valve means for directing fluid from an inlet port to some of the fluid chambers defined by said gerotor gears and for directing fluid from other fluid chambers to an outlet port according to the torque load imposed upon the output shaft, said gerotor gears defining a center line of eccentricity which separates expanding chambers from the contracting chambers as the gears rotate and orbit, said comutation valve means having a center line of commutation that separates the fluid chambers that are being communicated with said inlet port from the fluid chambers that are being communicated with said outlet port as gears rotate and orbit, means responsive to the torque load on said output shaft for enabling a change in the orientation of the center line of eccentricity of the gear set relative to the center line of commutation of the commutation valve means, said gerotor gears including an externally toothed inner gerotor gear and an internally toothed outer gerotor gear having one more tooth than said inner gear, the teeth of said inner and outer gerotor gears meshing to define said fluid chambers, said inner gerotor gear being coupled for joint rotation with said output shaft and eccentrically disposed relative to said outer gear so that said inner gerotor gear can rotate and orbit relative to said outer gerotor gear, said outer gear being rotatable relative to said inner gerotor gear in response to the torque load on said output shaft to change the orientation of the center line of eccentricity of the gear set relative to the center line of commutation of the commutation valve means.

3. A hydraulic motor as defined in claim 2 wherein said inner and outer gears are disposed in a housing and said outer gerotor gear can rotate to a limited extent relative to said housing to change the orientation of the center line of eccentricity relative to the center line of commutation, the gears having a predetermined orientation in which the center line of commutation coincides with the center line of eccentricity, the center line of commutation being angularly movable relative to the center line of eccentricity when the outer gerotor gear rotates relative to said housing, the motor having a predetermined displacement when the center line of commutation coincides with the center line of eccentricity, and the displacement of the motor changes as the angle between the center lines of commutation and eccentricity changes.

4. A hydraulic motor as defined in claim 3 including means biasing said outer gerotor gear toward an orientation in which the displacement of the motor is a minimum value, said outer gerotor gear of said gear set being rotatable against said biasing means to increase the displacement of the motor when the torque load on said output shaft causes forces to be exerted on said outer gerotor gear that exceed the biasing force of said biasing means.

5. A hydraulic motor as defined in claim 4 wherein said biasing means includes spring means acting between said outer gerotor gear and said housing.

6. A hydraulic motor as defined in claim 5 wherein said outer gerotor gear has a series of recesses and said housing includes a series of cooperating recesses in facing relationship with respective recesses in said outer gerotor gear, said biasing means comprising spring means disposed partially in said recesses in said housing and partly in said recesses in said outer gerotor gear, said spring means biasing said outer gerotor gear toward said orientation in which the displacement of said motor is a minimum value.

7. A hydraulic motor as defined in claim 6 including means for limiting fluid pressure in a chamber that is contracting at the same time the commutator switching said chamber from communication with one port to communication with another port including (i) a pressure cavity communicated with the inlet, (ii) fluid passages between said pressure cavity and each of said chambers, and (iii) a check valve in each of said fluid passages, each check valve preventing fluid flow from said pressure cavity to said chambers but allowing fluid flow from a chamber to the pressure cavity when fluid pressure in the chamber exceeds the fluid pressure in the fluid pressure cavity.

8. A hydraulic motor as defined in claim 7 wherein said biasing means biases said outer gerotor gear toward an orientation in which the angle between the center line of commutation and the center line of eccentricity is a predetermined maximum value in which the displacement of the motor is a minimum value, said outer gerotor gear being rotatable against said biasing means to decrease the angle between the center line of commutation and the center line of eccentricity, the motor having its maximum displacement when the center line of commutation coincides with the center line of eccentricity.

9. A hydraulic motor as defined in claim 7 wherein said gerotor gears form a first gerotor gear set, said hydraulic motor further including a second gerotor gear set comprising an outer gerotor gear which is fixed in said housing and a rotatable and orbital inner gerotor gear, the rotatable and orbital inner gerotor gears of said first and second gerotor gear sets being coupled for joint rotation with each other and with said output shaft, said center lines of eccentricity of said first and second gerotor gears sets being in line and the eccentricities of said first and second gear sets being out of phase with each other by 180° when the motor has its minimum displacement, the first and second gerotor gear sets having a common center line of commutation, the phase relationship of the eccentricities of the first and second gerotor gear sets being variable as the center line of eccentricity of said first gerotor gear set shifts angularly with respect to the center line of eccentricity of said second gear set and the displacement of said motor being variable by the amount the center lines of eccentricity of said first and second gerotor gear sets are angularly offset relative to each other.

10. A hydraulic motor including a gear set comprising relatively rotatable and orbital gerotor gears, said gerotor gears having intermeshing teeth which define fluid chambers that expand and contract as the gerotor gears rotate and orbit relative to each other, an output shaft, means coupling one of said gerotor gears with said output shaft for applying a torque to said output shaft as said gerotor gears rotate and orbit relative to each other, the expansion and contraction of the fluid chambers defined by said gerotor gears displacing fluid during each revolution of said output shaft, means permitting a change in the orientation of said gerotor gears in response to a change in the torque load on said output shaft to change the displacement as the gerotor gears rotate and orbit relative to each other, said gerotor gears being disposed in a housing, said means permitting a change in the orientation of said gerotor gears comprising means for rotatably supporting one of said gerotor gears in said housing and spring means biasing said one gerotor gear toward an orientation in which the motor has a predetermined minimum displacement, said one gerotor gear being rotatable in said housing to change the orientation of said gerotor gears and increase the displacement of the motor when the torque load on said output shaft causes a moment to be applied to said one gerotor gear which overcomes the bias of said spring means, said gerotor gears comprise an externally toothed inner gerotor gear and an internally toothed outer gerotor gear having one more tooth than said inner gerotor gear, the teeth of said inner and outer gerotor gears meshing to define said fluid chambers, said inner gerotor gear being coupled for joint rotation with said output shaft and being rotatable and orbitally movable relative to said outer gerotor gear, said outer gerotor gear being rotatable relative to said housing to change the orientation of said gerotor gears.

11. A hydraulic motor as defined in claim 10 wherein said outer gerotor gear is rotatably supported by a portion of said housing, and said biasing means includes spring means acting between said outer gerotor gear and said housing.

12. A hydraulic motor as defined in claim 11 wherein said outer gerotor gear has a series of recesses and said housing includes a series of cooperating recesses in facing relationship with respective recesses in said outer gerotor gear, said biasing means comprising spring means disposed partially in said recesses in said housing and partly in said recesses in said outer gerotor gear, said spring means biasing said outer gerotor gear toward said orientation in which the motor has a minimum displacement.

13. A hydraulic motor as defined in claim 12 wherein said gerotor gear set forms a first gerotor gear set, and wherein said hydraulic motor further includes a second gerotor gear set comprising an outer gerotor gear which is fixed in said housing and a rotatable and orbital inner gerotor gear, the inner gerotor gear of said second gerotor gear set being coupled for joint rotatation with said output shaft and with said inner gerotor gear of said first gerotor gear set, the eccentricity of said first and second gerotor gear sets being out of phase with each other, said means permitting a change in the orientation of said gerotor gears of said first gerotor gear set also permitting a change in the amount by which the eccentricity of said first gerotor gear set is out of phase with the eccentricity of said second gerotor gear set to change the displacement of the motor.

* * * * *